US005967785A

United States Patent [19]

Maeda et al.

[11] Patent Number: 5,967,785

[45] **Date of Patent: *Oct. 19, 1999**

[54] CABLE HOLDER AND CABLE FIXING METHOD

[75] Inventors: Osamu Maeda; Kunio Sawai, both of Osaka, Japan

[73] Assignee: Funai Electric Co. Ltd., Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/872,646

[22] Filed: Jun. 10, 1997

[30] Foreign Application Priority Data

Jun. 12, 1996 [JP] Japan ..... 8-150877

[51] Int. Cl.[6] ..... H01R 9/09

[52] U.S. Cl. ..... 434/77; 439/493; 439/495; 439/76.1

[58] Field of Search ..... 439/495, 493, 439/492, 499, 465–467, 77, 76.1

[56] References Cited

U.S. PATENT DOCUMENTS 5,111,362 5/1992 Flamm et al. .

5,466,162 11/1995 Schroepfer et al. ..... 439/493

FOREIGN PATENT DOCUMENTS 273529 11/1989 Germany ..... 439/493

5-62980 8/1993 Japan .

*Primary Examiner*—Gary F. Paumen

*Attorney, Agent, or Firm*—Lackenbach Siegel Marzullo Aronson & Greenspan, P.C.

[57] ABSTRACT

A cable holder for holding a flexible flat cable having a film portion, flat wires running in the film portion, a reinforcement portion where a reinforcement sheet is attached and notches formed respectively in opposite side edges of the reinforcement portion, to electrically connect the flexible flat cable to a connector. The cable holder comprises a holder body, a holder guide portion provided with the holder body, wherein an inner shape of the holder guide portion corresponds to an outer shape of the connector; and a cable holding portion having protuberances formed on the cable holding portion, for engaging respectively in the notches for holding the reinforcement portion of the flexible flat cable such that a distal end of the flexible flat cable projects into the holder guide portion.

8 Claims, 5 Drawing Sheets

CABLE HOLDER AND CABLE FIXING METHOD

BACKGROUND OF THE INVENTION

This invention relates to a cable holder which holds that portion of a flexible flat cable adjacent to a distal end thereof, thereby facilitating the connection of the flexible flat cable to a connector, and the invention also relates to a fixing method of fixing the flexible flat cable to the cable holder.

Signal-transferring cables, which enable the connection of a plurality of wires with high reliability, include a flexible printed circuit board (hereinafter referred to as "FPC"), having wires printed on a film, and a flexible flat cable (hereinafter referred to as "FFC") having flat-type soft copper wires covered with a film. For connecting these cables to a connector, there has been used a method in which a distal end portion of the cable is grasped, and then is inserted directly into the connector. In the case of using an FPC, there has been proposed techniques (for instance, Japanese Utility Model Unexamined Publication No. 5-62980) in which a cable holder is used. More specifically, when attaching a panel having the FPC to a body having a connector, the cable holder holds that portion of the cable adjacent to a distal end thereof. This construction eliminates a troublesome operation in which the distal end portion of the cable is grasped, and then is inserted into the connector, and this also eliminates an incomplete insertion of the FPC and an incomplete locking of the connector.

However, when the above method is applied to an FFC, the following problem has been encountered. In the conventional technique, in order to prevent a cable from being disengaged from a cable holder, retaining pins are formed on the cable holder. Also, holes for respectively receiving the retaining pins are formed in that portion of the cable to be held by the cable holder. FIG. 8 shows a condition in which in order to apply a similar method to an FFC, holes 91 for respectively retaining the pins are formed on a distal end portion of the cable.

Since the FFC is a cable having flat-type soft copper wires covered with a film, the wires are disposed in parallel, having the same intervals. Therefore, when the holes 91 are formed, two (or more) wires 92 are cut or severed, and can not be used. Thus, there has been encountered a problem that the rate of utilization of the cable has been lowered.

SUMMARY OF THE INVENTION

The present invention has been made in order to overcome the above problem, and an object of the invention is to provide a cable holder which prevents a cable utilization rate from being lowered even if the cable holder holds an FFC.

Another object of the invention is to provide a cable holder which achieves the above object, and can be mounted on a plate member such as a chassis.

Further object of the invention is to provide a cable holder which achieves the above objects, and in which when the cable holder is mounted on the plate member, a cable body can be led out at that side of the plate member where a connector, to which a flexible-flat cable is to be connected, is disposed.

Still further object of the invention is to provide a cable fixing method which facilitates a fixing operation when fixing a flexible flat cable to a cable holder, using an adhesive.

To achieve the objects, according to a first aspect of the invention provides a cable holder for holding a flexible flat cable having a film portion, flat wires running in the film portion, a reinforcement portion where a reinforcement sheet is attached and notches formed respectively in opposite side edges of the reinforcement portion, to electrically connecting the flexible flat cable to a connector, the cable holder comprising: a holder body; a holder guide portion provided with the holder body, wherein an inner shape of the holder guide corresponds to an outer shape of the connector; and a cable holding portion having protuberances formed on the cable holding portion, for engaging respectively in the notches for holding the reinforcement portion of the flexible flat cable such that a distal end of the flexible flat cable projects into the holder guide portion.

According to a second aspect, there is provided a cable holder for holding a flexible flat cable having an end portion, and connecting the end portion of the flexible flat cable to a connector, the cable holder comprising: a holder body; a holder guide portion provided with the holder body, wherein an inner shape of the holder guide corresponds to an outer shape of the connector; a cable holding portion provided with the holder body for holding the end portion of the flexible flat cable; and a pouring hole is formed in a wall of the cable holding portion wherein the flexible flat cable is fixedly secured to the holder body by an adhesive poured into the cable holding portion through the pouring hole.

According to a third aspect, there is provided a cable holder according to the first or second aspect, further comprising: a holder holding portion for holding the holder body on a holder holding hole formed in a plate member.

According to a fourth aspect, there is provided a cable holder according to the third aspect, further comprising: a lead-out opening is disposed on that side of the plate member where the holder guide portion is disposed, for leading the flexible flat cable from the cable holding portion while the holder body is held on the plate member by the holder holding portion.

According to a fifth aspect, there is provided a fixing method of fixing a flexible flat cable to a cable holder in order to connect the flexible flat cable to a connector, comprising the steps of: (*a*) engaging a holder guide portion of the cable holder with a positioning adaptor having an outer shape corresponding to an inner surface of the holder guide portion having a shape corresponding to an outer shape of the connector, the positioning adaptor having a positioning slit of a predetermined depth formed at a position corresponding to an insertion slit in the connector; (*b*) inserting a distal end portion of the flexible flat cable into a lead-out opening, which leads the flexible flat cable out of a cable holding portion, until the distal end portion reaches a bottom of the positioning slit; and (*c*) pouring an adhesive through a pouring hole formed in the cable holding portion, with the distal end portion held in contact with the bottom of the positioning slit.

DETAILED DESCRIPTION OF THE PREFERRED EMBODIMENTS

A preferred embodiment of the present invention will now be described with reference to the drawings.

Figure 1:
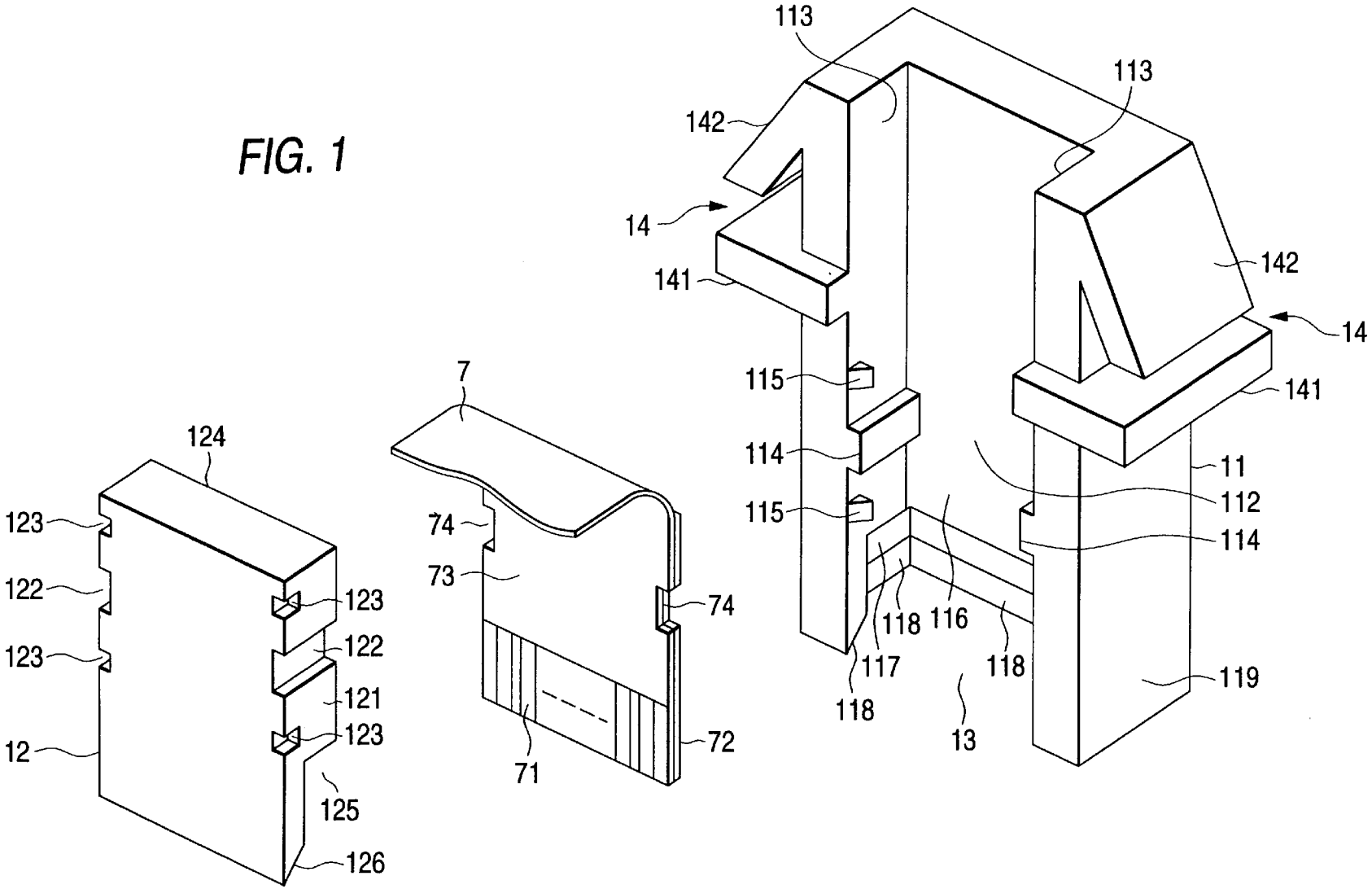
FIG. 1 is a perspective view showing a first embodiment of a cable holder of the present invention.
Figure 2:
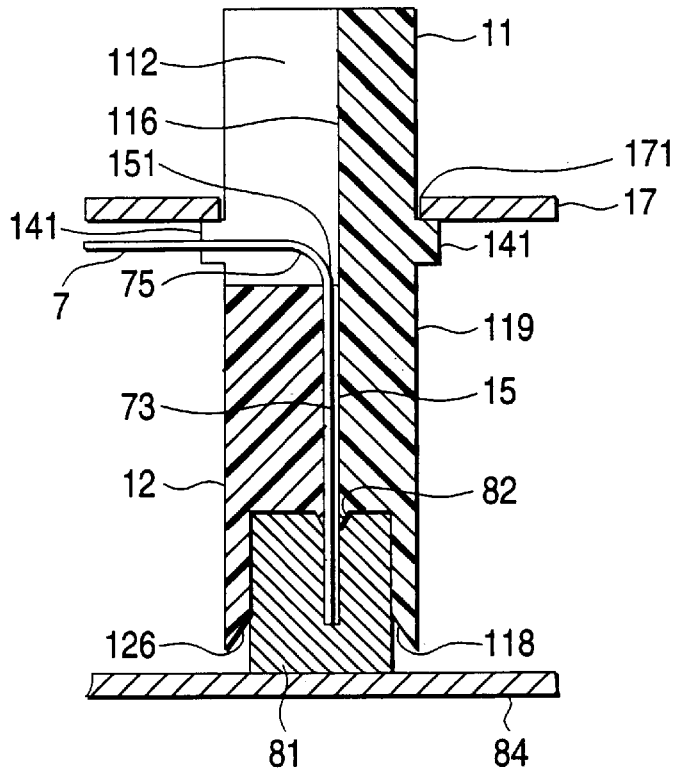
FIG. 2 is a cross-sectional view showing a condition in which the cable holder of the embodiment of FIG. 1 is connected to a connector.

FIG. 1 is a perspective view showing a first embodiment of a cable holder of the present invention. FIG. 2 is a cross-sectional view showing a condition in which the cable holder of this embodiment is connected to a connector.

In the drawings, an insulating film, covering wires, is removed a predetermined length from one side of a distal end portion of a flexible flat cable (hereinafter referred to as "FFC") 7 to form an electrically-conductive portion 71. A reinforcement sheet 72 in the form of a thin resin plate is affixed or bonded to the other side of the FFC, facing away from the conductive portion 71, at the distal end portion thereof. The distal end portion of the FFC 7, having the reinforcement sheet 72 affixed thereto, serves as a reinforcement portion 73, and a pair of notches 74 of a generally U-shape are formed respectively in opposite side edges of the reinforcement portion 73.

Figure 3:
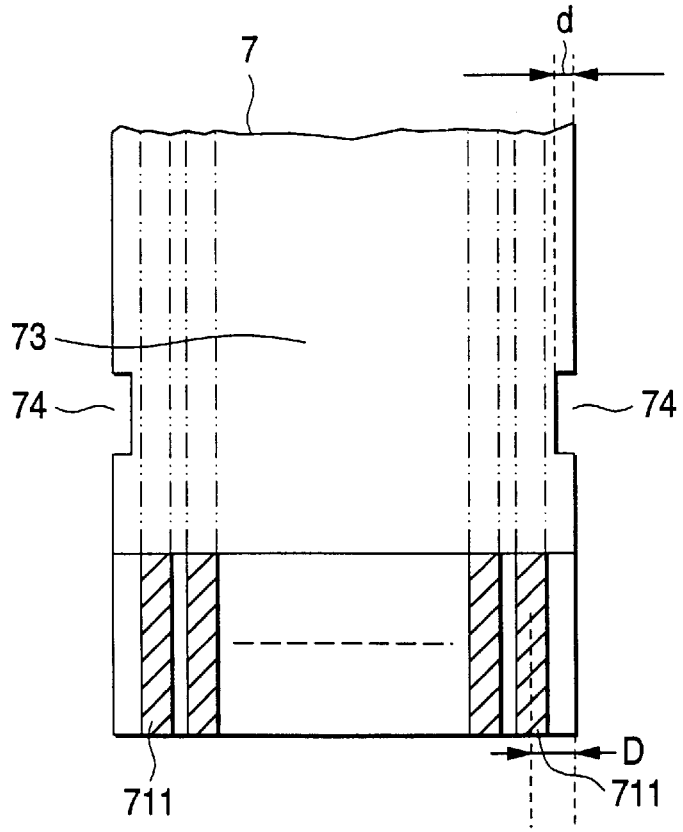
FIG. 3 is a view showing a shape of a distal end portion of a flexible flat cable.

FIG. 3 shows the configuration of the notches 74 in detail. In order to enhance a retaining effect by the notches 74, it is necessary to increase a width d of the notches 74 to such an extent that they will not reach respective wires 711 disposed respectively at opposite side edge portions of the cable. Therefore, in this embodiment, the width d is about 0.6 mm when the width D between a side end of the cable and the center line of the wire 711 is about 1.25 mm.

A holder body for holding the reinforcement portion 73 of the FFC 7 comprises a holder main portion 11 and a holder auxiliary portion 12, and a recess 112, having a width equal to the cable width of the FFC 7, formed in the holder main portion 11. An elongate protuberance 114, having a substantially same shape in cross section as of the notch 74 in the FFC 7, is formed on each of opposite side walls 113 of the recess 112.

The holder auxiliary portion 12 can be pushed and fitted into the recess 112 in the holder main portion 11 from the front side thereof, and so that the holder auxiliary portion 12 can be fixed to the holder main portion 11. Therefore, a pair of grooves 122 of a generally U-shaped cross-section, corresponding respectively to the protuberances 114, are formed respectively on opposite side walls 121 of the holder auxiliary portion 12. For preventing the holder auxiliary portion 12, fitted into the holder main portion 11 from the front side thereof, from being disengaged therefrom, two retaining pawls-115 are formed on each of the opposite side walls 113 of the recess 112 in the holder main portion 11, and are disposed adjacent to an edge thereof. Notches 123, corresponding respectively to the retaining pawls 115, are formed in each of the opposite side walls 121 of the holder auxiliary portion 12.

A recessed portion 117 is formed in the opposite side walls 113 and a bottom surface 116 of the recess 112 at a lower portion of the holder main portion 11. Also, a recessed portion 125 is formed in a lower portion of an inner side or surface 124 of the holder auxiliary portion 12. When the holder auxiliary portion 12 is fixed to the holder main portion 11 by the retaining pawls 115, a space is defined by the surfaces of the recessed portion 117 of the holder main portion 11 and the surface of the recessed portion 125 of the holder auxiliary portion 12. The special configuration of the space conforms to an outer shape of the connector 81. The space, defined by the surfaces of the recessed portion 117 of the holder main portion 11 and the surface of the recessed portion 125 of the holder auxiliary portion 12, serves as a holder guide portion 13. An inclined surface 118 is formed at the lower end of the recessed portion 117, and an inclined surface 126 is formed at the lower end of the recessed portion 125, and these inclined surfaces facilitate the engagement of the holder with the connector 81.

A flange 141 is formed on that portion of the holder main portion 11 spaced slightly from its central portion toward its upper end, the flange 141 having a rectangular plane shape. The flange 141 is formed only on an outer surface 119 of the holder main portion 11, and is not formed at the region where the recess 112 exists. A pair of retaining pawls 142, cooperating with the flange 141, are formed respectively on opposite outer side surfaces (which are part of the outer surface 119) of the holder main portion 11 at the upper end thereof, and the flange 141 and the retaining pawls 142 cooperate with each other to provide a holder holding portion 14 for holding the holder body on a plate member 17.

A depth of the recess 112 in the holder main portion 11 is equal to the sum of the thickness of the holder auxiliary portion 12 and the thickness of the reinforcement portion 73 of the FFC 7. Therefore, when the holder auxiliary portion 12 is fixed to the holder main portion 11 by the retaining pawls 115, a gap, equal to the thickness of the reinforcement portion 73 of the FFC 7, is formed between the bottom surface 116 of the holder main portion and the inner surface 124 of the holder auxiliary portion 12. This gap defines a cable holding portion 15 for holding the reinforcement portion 73 of the FFC 7.

For attaching the FFC 7 to the cable holder of the above construction, the notches 74 in the FFC 7 are registered with the protuberances 114, respectively, and in this condition the FFC 7 is pushed toward the bottom surface 116. Then, the grooves 122 in the holder auxiliary portion 12 are registered with the protuberances 114, respectively, and in this condition the holder auxiliary portion 12 is pressed toward the holder main portion 11. The thus pressed holder auxiliary portion 12 slightly expands an open side of the recess 112, and moves toward the bottom surface 116. Then, when the holder auxiliary portion 12 is further pressed, the retaining pawls 115 are engaged respectively in the notches 123, with the gap (corresponding to the thickness of the reinforcement portion 73) formed between the holder auxiliary portion 12 and the holder main portion 11. Therefore, the holder auxiliary portion 12 is fixed to the holder main portion 11 by the retaining pawls 115. At the same time, the holder auxiliary portion 12 cooperates with the holder main portion 11 to hold the reinforcement portion 73.

Thus, when the FFC 7 is held by the holder main portion 11 and the holder auxiliary portion 12, the notches 74 are engaged with the protuberances 114, respectively, and therefore the FFC 7 is firmly held against movement in the length of the cable, with the distal end portion of the cable projected into the holder guide portion 13.

The plate member 17 shown in FIG. 3 is, for example, a plate member, such as a chassis, having a mechanical portion of a video cassette recorder mounted thereon, and the plate member 17 has a rectangular mounting hole 171 larger in size a predetermined amount than the cross-sectional shape of the outer surface 119 of the holder main portion 11. The upper end portion of the holder main portion 11 (holder body) holding the FFC 7 is passed through this mounting hole 171 from the lower side. When the upper end portion of the holder main portion 11 above the flange 141 is passed through the mounting hole 171, the retaining pawls 142, moved toward each other during this passing operation, are moved away from each other. As a result, the holder main portion 11 (holder body) is retained on the plate member 17 by the flange 141 and the retaining pawls 142. Thus, the holder body is attached to the plate member 17.

The chassis (plate member) 17, having the holder body mounted thereon, is moved downward so that the holder guide portion 13 of the holder body can be engaged with the connector 81 mounted on a main circuit board 84. The mounting hole 171, formed through the plate member 17, is larger in size a predetermined amount than the cross-sectional shape of the outer surface 119 in a right-left direction and a forward-rearward direction. Therefore, when the plate member 17 is moved downward, the holder main portion 11 is so moved by the inclined surfaces 118 and 126 of the holder guide portion 13 as to absorb an error of the mounting position (that is, error in the right-left direction and the forward-backward direction) relative to the connector 81, so that the holder main portion 11 is guided to a predetermined position by the holder guide portion 13. As a result, the distal end portion of the FFC 7 is guided and inserted into an insertion slit 82 in the connector 81.

At this time, if there is an error in height of the connector 81, so that the connector 81 is located at a position lower than a predetermined position, the plate member 71 is pressed hard downward to engage the holder body with the connector 81 in such a manner that the distal end of the FFC 7 reaches the bottom of the insertion slit 82. Then, the downwardly-pressing force is removed from the plate member 17, the plate member may be lifted or raised slightly. However, even if the plate member 17 is lifted, the retaining pawls 142 are flexed away from each other, thereby absorbing the lift of the plate member 17. Therefore, the engagement of the holder body with the connector 81 is maintained, with the distal end of the FFC 7 held in contact with the bottom of the insertion slit 82. Namely, if an error in the upward-downward positional relation is within an allowable range, this error is also absorbed, thereby ensuring the positive connection between the FFC 7 and the connector 81.

In the condition in which the distal end portion of the FFC 7 is inserted into the insertion slit 82, with the conductive portion 71 connected to electrodes (not shown) of the connector 81, a lead-out opening 151 for leading a cable body 75 out of the cable holding portion 15 is disposed on that side of the plate member 17 where the holder guide portion 13 is disposed. Therefore, the cable body 75 can be led out on that side where the holder guide portion 13 is disposed.

As a result, in the case where the other end (not shown) of the FFC 7 is connected to a board or the like provided on a lower surface of the plate member 17, the distal end portion of the FFC 7 can be connected to the connector 81 without the need for leading the cable body 75 to a position on the upper side of the plate member 17. Namely, when the other end of the cable body 75 is connected to the associated member on the lower side of the plate member 17, the installation of the cable body 75 can be simplified.

Figure 4:
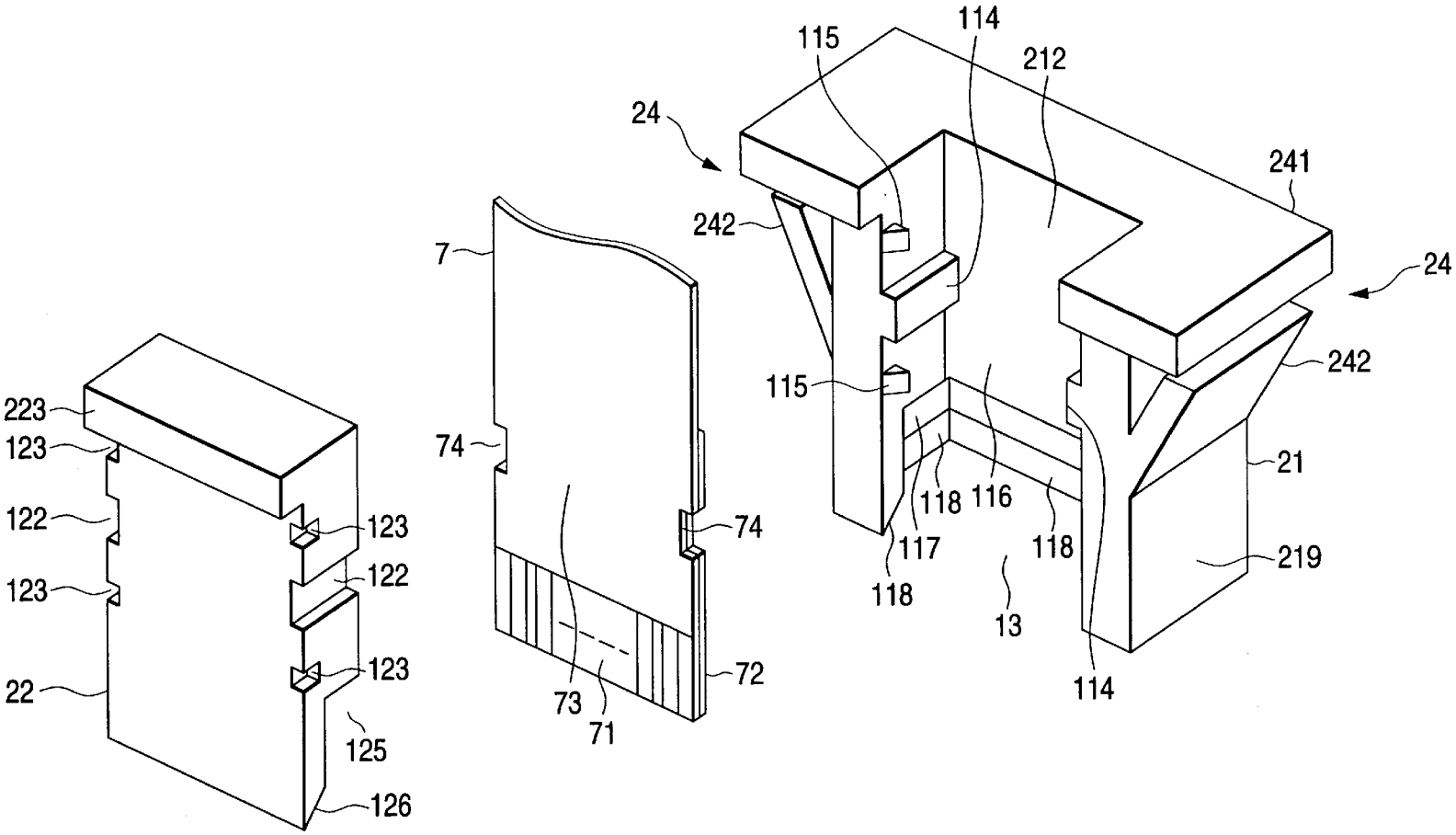
FIG. 4 is a perspective view showing a second embodiment of a cable holder of the invention.

FIG. 4 is a perspective view showing a second embodiment of a cable holder of the invention. Those portions identical to those shown in FIG. 1 will be designated by identical reference numerals, respectively, and detailed explanation thereof will be omitted.

In this embodiment, also, a holder body comprises two parts, that is, a holder main portion 21 and a holder auxiliary portion 22. A width of a recess 212, formed in the holder main portion 21, is equal to the width of the FFC 7. The recess 212 has protuberances 114, retaining pawls 115, a recessed portion 117, and an inclined surface 118. The holder auxiliary portion 22 has grooves 122, notches 123, a recessed portion 125 and an inclined surface 126. A depth of the recess 212 is equal to the sum of the thickness of the holder auxiliary portion 22 and the thickness of the reinforcement portion 73. When the holder auxiliary portion 22 is fixed to the holder main portion 21, a holder guide portion 13 is formed by the recessed portion 117 and the recessed portion 125.

A flange 241 is formed at an upper end of the holder main portion 21 at an upper end, the flange 141 having a rectangular plane shape. The flange 241 is formed only on an outer surface 219 of the holder main portion 21, and is not formed at the region where the recess 212 exists. A pair of retaining pawls 242, cooperating with the flange 241, are formed respectively on opposite outer side surfaces (which are part of the outer surface 219) of the holder main portion 21, and are disposed below the flange 241. An elongate projection 223 is formed at an upper end of the holder auxiliary portion 22, and when the holder auxiliary portion 22 is attached to the holder main portion 21, the elongate projection 223 fits in the interrupted portion of the flange 241. The flange 241, the elongate projection 223 and the retaining pawls 242 jointly constitute a holder holding portion 24 for holding the holder body on a plate member 17.

In this embodiment, a lower end portion of the holder body (comprising the holder main portion 21 and the holder auxiliary portion 22), holding the FFC 7, is passed through a rectangular mounting hole (having the same shape as that of the mounting hole 171 shown in FIG. 3) formed through the plate member 17. When the holder body is passed through the mounting hole to a predetermined position, the retaining pawls 242 are moved away from each other, so that the holder body is held by the plate member. In this case, the FFC 7 is led out from the upper side of the plate member. Therefore, if the other end (not shown) of the FFC 7 is connected to a board or the like provided on the upper surface of the plate member 17, the distal end portion of the FFC 7 can be connected to the associated member without the need for leading a cable body 75 to a position on the lower side of the plate member 17. Namely, when the other end of the cable body 75 is connected to the associated member on the upper side of the plate member 17, the installation of the cable body 75 can be simplified.

Figure 5:
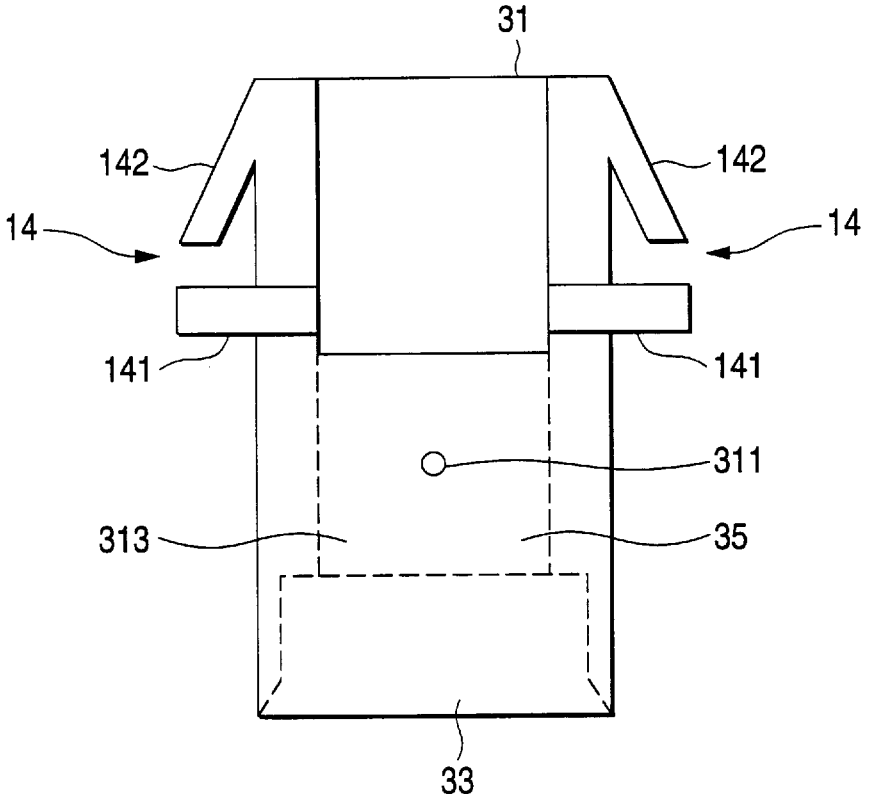
FIG. 5 is a front-elevational view of a third embodiment of a cable holder of the invention.
Figure 6:
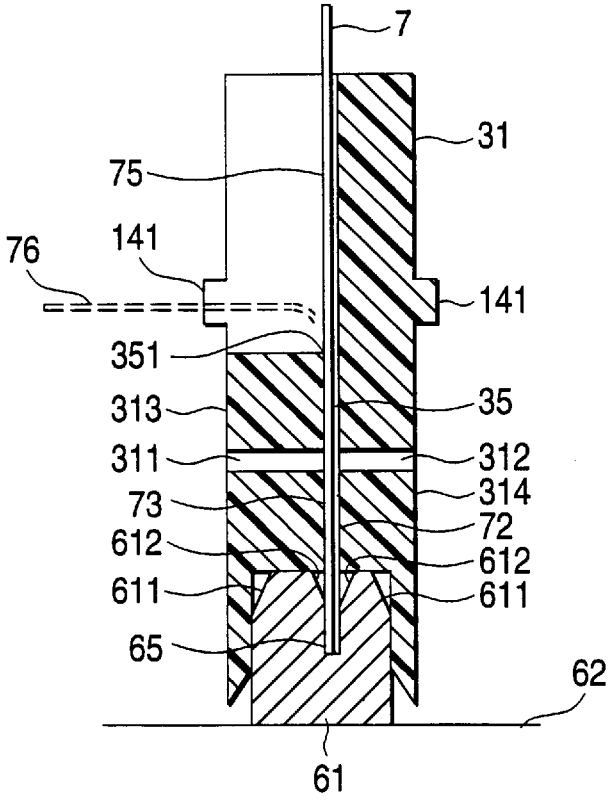
FIG. 6 is a cross-sectional view showing a condition in which the cable holder of the embodiment of FIG. 5 is attached to a positioning adaptor.

FIG. 5 is a front-elevational view of a third embodiment of a cable holder of the invention. FIG. 6 is a cross-sectional view showing a condition in which the cable holder of this embodiment is attached to a positioning adaptor.

A holder body 31 of this embodiment has the same outer shape as obtained when the holder auxiliary portion 12 is fixed in position to the holder main body 11 of the first embodiment, with the notches 123 omitted. Therefore, those portions identical to those shown in FIG. 1 will be designated by identical reference numerals, and detailed explanation thereof will be omitted.

A cable holding portion 35 (which is shown in broken lines since it is an internal structure) is identical in shape to the cable holding portion 15 of the first embodiment except that any protuberances are not formed in the cable holding portion 35. More specifically, the cable holding portion 35 has a uniform slit-like cross-sectional shape throughout its length from its upper end to lower end. A holder guide portion 33 identical in shape to the holder guide portion 13 of the first embodiment is formed in the lower end portion of the holder body 31. When the holder body 31 is mounted on a plate member, a lead-out opening 351 for leading a cable body 75 out of the cable holding portion 35 is disposed on that side of the plate member where the holder guide portion 33 is disposed.

A pouring hole 311 is formed through a front wall portion 313, disposed on the front side of the cable holding portion 35, at a generally central portion thereof, and extends from an outer surface of the front wall portion 313 to the cable holding portion 35. A pouring hole 312 is formed through a rear wall portion 314, disposed on the rear side of the cable holding portion 35, at a generally central portion thereof, and extends from an outer surface of the rear wall portion 314 to the cable holding portion 35. An FFC 7 used in this embodiment is identical in construction to the FFC shown in FIG. 1 except that the notches 74, formed in the reinforcement portion 73, are omitted. In the FFC 7 used in this embodiment, a reinforcement sheet 72 is affixed to a distal end portion of this cable to form a reinforcement portion 73.

A fixing method of fixing the holder body 31 of the above construction to the FFC 7 will now be described.

For fixing the FFC 7 to the holder body 31, the positioning adaptor 61 is used. This positioning adaptor 61 is a jig having the same outer shape as that of a connector (which is the same as the connector shown in FIG. 3) corresponding to the holder guide portion 33, and this positioning adaptor 61 is fixed to a working base 62. A positioning slit 65 is formed in the positioning adaptor 61 at a position corresponding to the insertion slit 82 in the connector 81, the positioning slit 65 having generally the same shape and the same depth as those of the insertion slit 82. Inclined surfaces 611 are formed respectively at upper edges of the positioning adaptor 61 so as to facilitate the engagement of the positioning adaptor 61 in the holder guide portion 33. Inclined surfaces 612 are formed at edges of an inlet portion of the positioning slit 65 so as to facilitate the insertion of the distal end portion of the FFC 7 into this slit 65.

For fixing the FFC 7 to the holder body 31, the holder guide portion 33 is engaged with the positioning adaptor 61. When the holder guide portion 33 is engaged with the positioning adaptor 61, the holder body 31 is held by the positioning adaptor 61. In this condition, the FFC 7 is inserted into the lead-out opening 351. The distal end of the FFC 7, thus inserted into the lead-out opening 351, passes through the cable holding portion 35, and reaches the bottom of the positioning slit 65. When this distal end reaches the bottom of the positioning slit 65, the FFC 7 is projected into the holder guide portion 33 by an amount required for connection to the connector.

In this condition, a suitable amount of an adhesive is injected under pressure into each of the pouring holes 311 and 312. The adhesive, injected into the pouring hole 311, is filled in a gap between one side of the reinforcement portion 73 and an inner surface of the cable holding portion 35, while the adhesive, injected into the pouring hole 312, is filled in a gap between the other side of the reinforcement portion 73 and an inner surface of the cable holding portion 35. The thus filled adhesive is cured or solidified, so that the FFC 7 is fixedly secured to the holder body 31.

Broken lines 76 in FIG. 6 indicate the direction of extending of the cable body 75, led out of the lead-out opening 351, when the holder body 31 is mounted on the plate member.

Figure 7:
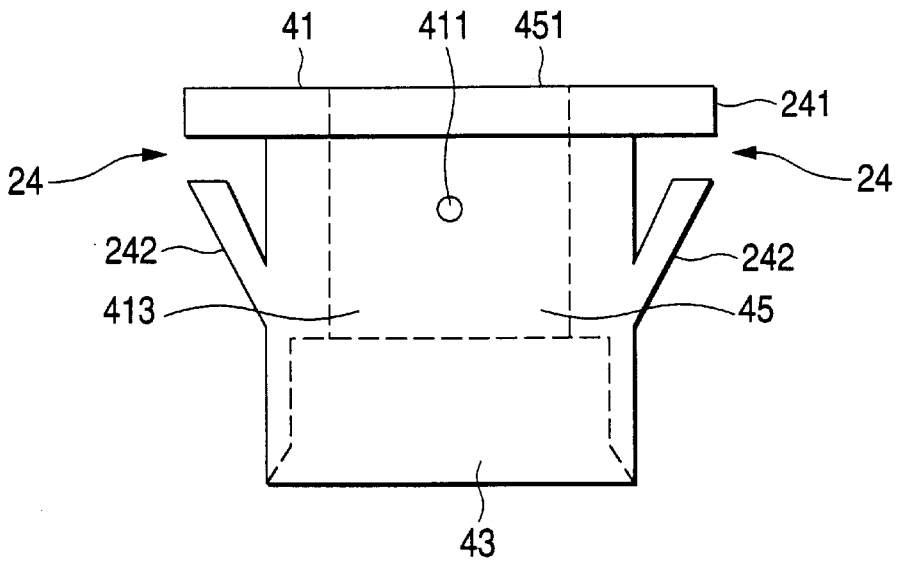
FIG. 7 is a front-elevational view of a fourth embodiment of a cable holder of the invention.
Figure 8:
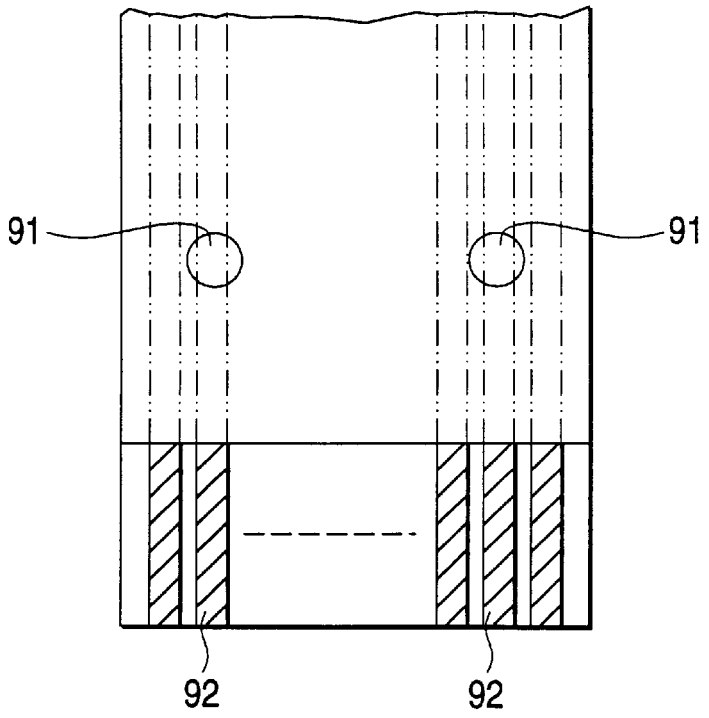
FIG. 8 is a view showing a distal end portion of a flexible flat cable.

FIG. 7 is a front-elevational view of a fourth embodiment of a cable holder of the invention.

A holder body 41 of this embodiment has the same outer shape as obtained when the holder auxiliary portion 22 is fixed in position to the holder main body 21 of the second embodiment, with the notches 123 omitted. Therefore, those portions identical to those shown in FIG. 4 will be designated by identical reference numerals, and detailed explanation thereof will be omitted.

A cable holding portion 45 (which is shown in broken lines since it is an internal structure) is identical in shape to the cable holding portion of the second embodiment except that any protuberances are not formed in the cable holding portion. More specifically, the cable holding portion 45 has a uniform slit-like cross-sectional shape throughout its length from its upper end to lower end. A holder guide portion 43 identical in shape to the holder guide portion 13 of the second embodiment is formed in the lower end portion of the holder body 41. When the holder body 41 is mounted on a plate member, a lead-out opening 451 for leading a cable body 75 out of the cable holding portion 45 is disposed on that side of the plate member facing away from the holder guide portion 43.

A pouring hole 411 is formed through a front wall portion 413, disposed on the front side of the cable holding portion 45, at a generally central portion thereof, and extends from an outer surface of the front wall portion 413 to the cable holding portion 45, while a pouring hole (not shown) is formed through a rear wall portion (not shown), disposed on the rear side of the cable holding portion 45, at a generally central portion thereof, and extends from an outer surface of the rear wall portion to the cable holding portion 45. An FFC 7 used in this embodiment is identical to the FFC used in the third embodiment. A fixing method of fixing the FFC 7 to this embodiment of the above construction is the same as the fixing method of fixing the FFC 7 to the third embodiment, and therefore explanation thereof will be omitted.

As described above, in the third and fourth embodiments, the holder body can be molded into an integral construction. Therefore, the holder body can be produced at a lower cost. And besides, since there is no need to form the notches 74 in the reinforcement portion 73, the processing of the FFC 7 is simplified.

The present invention is not limited to the above embodiments, and in the first and second embodiments, although the notches 74 have a generally U-shape, these notches can have any other suitable shape such as a semi-circular shape with a radius of about 0.6 mm in so far as these notches will not cut or sever the wires 711 disposed respectively at the opposite side edge portions of the cable, and more than two notches may be formed if the required strength is secured.

In the cable holder according to the first aspect of the invention which holds the flexible flat cable including the cable body having the reinforcement sheet bonded to the distal end portion thereof over a predetermined area to form the reinforcement portion, the notches are formed respectively in the opposite side edges of the reinforcement portion, and the holder body has the holder guide portion whose inner shape corresponds to the outer shape of the connector, and the cable holding portion for holding the reinforcement portion, with the distal end portion projected into the holder guide portion, and the protuberances for being engaged respectively in the notches are formed in the cable holding portion.

In the cable holder according to the second aspect of the invention, the holder body has the holder guide portion whose inner shape corresponds to the outer shape of the connector, and the holder body has the cable holding portion for holding that portion of the cable body, disposed adjacent to the distal end portion thereof, over a predetermined area, with the distal end portion projected into the holder guide portion, and the pouring holes are formed in the walls of the cable holding portion, and the cable body is fixedly secured to the holder body by the adhesive poured into the cable holding portion through the pouring holes.

In the first and second aspects, any fixing holes for fixing the cable do not need to be formed in the cable body, and therefore the wires will not be cut or severed, and even if the FFC is held by the cable holder, the rate of utilization of the cable is prevented from being lowered.

In the cable holder according to the third aspect of the invention, the holder body has the holder holding portion for holding the holder body on the plate member when the holder body is extended through the holder holding hole formed through the plate member. The holder body is held on the plate member by the holder holding portion, and therefore the holder body can be mounted on the plate member such as a chassis.

In the cable holder according to the fourth aspect of the invention, when the holder body is held on the plate member by the holder holding portion, the lead-out opening for leading the cable body from the cable holding portion is disposed on that side of the plate member where the holder guide portion is disposed. Therefore, when the holder body is mounted on the plate member, the cable body can be led out on that side where the connector, to which the flexible flat cable is connected, is disposed.

In the fixing method of the invention for fixing the flexible flat cable to the cable holder, the holder body has the holder guide portion whose inner shape corresponds to the outer shape of the connector, and the cable holding portion for holding that portion of the flexible flat cable, disposed adjacent to the distal end portion thereof, over a predetermined area, with the distal end portion projected into the holder guide portion, and the pouring hole is formed in the wall of the cable holding portion, the holder guide portion is engaged with the positioning adaptor having the outer shape corresponding to the inner surface of the holder guide portion, the positioning adaptor having the positioning slit of a predetermined depth formed at the position corresponding to the insertion slit in the connector, and the distal end portion is inserted into the lead-out opening, which leads the flexible flat cable out of the cable holding portion, until the distal end portion reaches the bottom of the positioning slit, and the adhesive is poured through the pouring hole, with the distal end portion held in contact with the bottom of the positioning slit. When the holder guide portion is engaged with the positioning adaptor, the holder body is held by the positioning adaptor, and therefore the flexible flat cable can be easily inserted into the lead-out opening. Merely by inserting the flexible flat cable until the distal end reaches the bottom of the positioning slit, a predetermined length of the flexible flat cable is projected into the holder guide portion, and therefore a separate step of determining this cable-projecting length is not necessary. Therefore, the fixing operation for fixing the flexible flat cable to the cable holder by the adhesive can be carried out easily.

What is claimed is:

1. A cable holder for connecting to a connector, said cable holder comprising:

a flexible flat cable having a cable portion and an end portion;

a holder body including a main body having a chamber in which a first recessed portion is provided, and a support body having a second recessed portion and being inserted into the chamber of said main body;

a holder guide portion defined by said first recessed portion and said second recessed portion, wherein an inner shape of said holder guide corresponds to an outer shape of the connector;

a cable holding portion provided with said holder body for holding the end portion of the flexible flat cable, wherein said cable portion of said flexible flat cable is led out from said cable holding portion; and fixing means for securing the flexible flat cable to said cable holding portion such that a distal end of the end portion of the flexible flat cable is positioned in said holder guide portion.

2. The cable holder according to claim 1, wherein said fixing means comprises:

a notched portion having notches formed respectively in opposite side edges of the end portion; and protuberances formed on said main body, for engaging said notches; and recesses formed on said support body for engaging with said protuberances with which said notches are engaged.

3. The cable holder according to claim 2 further comprises:

a holder holding portion for holding said holder body on a holder holding hole formed in a plate member.

4. The cable holder according to claim 3 further comprises:

a lead-out opening is disposed on that side of the plate member where said holder guide portion is disposed, for leading the flexible flat cable from said cable holding portion while said holder body is held on the plate member by said holder holding portion.

5. The cable holder according to claim 1, wherein said fixing means comprises:

a pouring hole is formed in a wall of said cable holding portion wherein the flexible flat cable is fixedly secured to said holder body by an adhesive poured into said cable holding portion through said pouring hole.

6. The cable holder according to claim 5 further comprises:

a holder holding portion for holding said holder body on a holder holding hole formed in a plate member.

7. The cable holder according to claim 6 further comprises:

a lead-out opening is disposed on that side of the plate member where said holder guide portion is disposed, for leading the flexible flat cable from said cable holding portion while said holder body is held on the plate member by said holder holding portion.

8. A cable holder for electrically connecting to a connector said cable holder comprising:

a flexible flat cable having a film portion, flat wires running in the film portion, a reinforcement portion where a reinforcement sheet is attached and notches formed respectively in opposite side edges of the reinforcement portion;

a holder body including a main body having a first recessed portion and a support body having a second recessed portion and being engaged with said main body;

a holder guide portion defined by said first recessed portion and said second recessed portion, wherein an inner shape of said holder guide portion corresponds to an outer shape of the connector;

protuberances formed on said main body for engaging respectively with said notches for holding the reinforcement portion of the flexible flat cable such that a distal end of the flexible flat cable projects into said holder guide portion, and that said cable portion of said flexible flat cable is led out from said cable holding portion; and recesses formed on said support body for engaging with the protuberances with which said notches are engaged.

* * * * *